US006729507B2

(12) United States Patent
Nagahata et al.

(10) Patent No.: US 6,729,507 B2
(45) Date of Patent: May 4, 2004

(54) LIQUID FILLING NOZZLE AND LIQUID FILLING APPARATUS

(75) Inventors: Kuniyoshi Nagahata, Iwakuni (JP); Namiyoshi Tanaka, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 10/370,257

(22) Filed: Feb. 20, 2003

(65) Prior Publication Data

US 2003/0155384 A1 Aug. 21, 2003

(30) Foreign Application Priority Data

Feb. 20, 2002 (JP) ..... 2002-043917

(51) Int. Cl.[7] ..... B67D 3/00
(52) U.S. Cl. ..... 222/504; 222/108
(58) Field of Search ..... 222/504, 108, 222/559

(56) References Cited

U.S. PATENT DOCUMENTS

| | | | | |
|---|---|---|---|---|
| 3,128,915 A | * | 4/1964 | Matter | 222/156 |
| 5,004,009 A | | 4/1991 | Bunce | |
| 5,137,187 A | * | 8/1992 | Nichols et al. | 222/504 |
| 5,775,387 A | | 7/1998 | Kaneko | |
| 5,878,992 A | | 3/1999 | Edwards et al. | |
| 5,957,343 A | * | 9/1999 | Cavallaro | 222/504 |

FOREIGN PATENT DOCUMENTS

| | | |
|---|---|---|
| FR | 2 208 376 | 6/1974 |
| JP | 61-123097 | 8/1986 |
| JP | 2-28402 | 2/1990 |
| JP | 4-201801 | 7/1992 |
| JP | 7-2479 | 1/1995 |
| JP | 2919202 | 4/1999 |
| JP | 11-193094 | 7/1999 |
| WO | WO 01/40098 | 6/2001 |

* cited by examiner

*Primary Examiner*—Philippe Derakshani
(74) *Attorney, Agent, or Firm*—Koda & Androlia

(57) ABSTRACT

A liquid filling nozzle including: a tubular nozzle main body having a liquid supply opening and a liquid discharge port, a center rod disposed inside the nozzle main body and raised and lowered, and an opening-and-closing valve body which opens the liquid discharge port when the center rod is lowered and closes the liquid discharge port when the center rod is raised. A throttle valve mechanism formed by a throttle valve seat, which is disposed on the inside wall surface of the nozzle main body, and a throttle valve body, which is disposed on the center rod, is provided in the filling nozzle so that the throttle valve mechanism opens when the center rod is lowered, and, when the center rod is raised, the throttle valve mechanism closes before the opening-and-closing valve body closes off the liquid discharge port, thus constricting the flow path for a liquid.

6 Claims, 4 Drawing Sheets

LIQUID FILLING NOZZLE AND LIQUID FILLING APPARATUS

BACKGROUND OF THE INVENTION

1. Field of the Invention

The present invention relates to a filling nozzle of a liquid filling machine and more particularly to a filling nozzle which is suitable for use in a pressurizing tank type liquid filling apparatus in which a predetermined liquid pressure is constantly applied to the liquid in a liquid flow path.

2. Prior Art

The liquid filling apparatus described in Japanese Patent Application Laid-Open (Kokai) No. 11-193094 is a rotary type filling apparatus. This filling apparatus includes filling nozzles, a pressurizing tank and a liquid passage (pipe channel). The filling nozzles are disposed at fixed intervals in a plurality of locations along the circumferential direction of a rotary body that rotates continuously, and they fill containers with a liquid. The pressurizing tank stores the liquid, and the liquid passage (pipe channel) branches from the pressurizing tank via a distribution chamber and is connected to the respective filling nozzles.

This liquid filling apparatus uses filling nozzles which are opened and closed by opening-and-closing valves that are raised and lowered only in the discharge ports that are provided at the lower ends of the nozzles. In such an apparatus, since a predetermined liquid pressure is constantly applied to the liquid inside the flow path, the gap at the discharge ports is abruptly constricted so that the flow velocity of the liquid increases when the discharge ports of the filling nozzles are closed by the opening-and-closing valves. As a result, the liquid is forcefully scattered to the outsides from the discharge ports. Thus, the filling apparatus has several problems. The liquid with which the containers are filled is caused to foam, and the containers are contaminated by the scattered liquid. Furthermore, after the discharge ports are closed off, liquid droplets adhere to the lower end of the discharge ports, and these droplets fall as a dripping liquid, contaminating the containers and the area around the containers.

In order to solve these problems, the inventors of the present application studied the use of a filling nozzle that includes a throttle valve installed on the upstream side of the opening-and-closing valve of the discharge port. Such a nozzle is disclosed in Japanese Utility Model Application Laid-Open (Kokai) No. 61-123097, Japanese Patent Application Laid-Open (Kokai) No. 4-201801, Japanese Utility Model Application Publication (Kokoku) No. 7-2479, Japanese Patent No. 2919202, etc. The inventors' study, however, found several problems in the nozzles disclosed in these prior art.

The problems of the filling nozzle disclosed in Japanese Utility Model Application Laid-Open (Kokai) No. 61-123097 are as follows: (1) In cases where a so-called "cleaning-in-place" or "CIP" in which cleaning water is caused to flow through the nozzle with the discharge port opened, the areas between O-rings are cleaned. As a result, it is necessary to disassemble the nozzle, making the maintenance characteristics poor. (2) Numerous O-rings are installed, and they are in constant rubbing contact with the inside surface of the nozzle main body. Such O-rings become worm, and debris is admixed with the liquid. Thus, O-ring replacement must be performed frequently, and this requires disassembly of the nozzle, resulting in poor maintenance characteristics. (3) Because a throttle valve part is installed in the supply opening in the nozzle's side wall, the structure of the throttle valve body is complicated, and thus the working costs tend to be high amount.

In the filling nozzle of Japanese Patent Application Laid-Open (Kokai) No. 4-201801, the scattering of the liquid is suppressed to some extent. However, the dripping of this liquid is not suppressed.

In the case of the filling nozzle of Japanese Patent Application Publication (Kokoku) No. 7-2479, the liquid located beneath the larger-diameter intermediate shaft part is pushed toward the discharge port when the larger-diameter intermediate shaft part is lowered. As a result, a jet of the liquid from the gap at the discharge port immediately prior to the closing of the opening-and-closing valve is suppressed.

The filling nozzle of Japanese Patent No. 291202 has the following problems: (1) The structure of the throttle valve is complicated, and costs are high. (2) Since the throttle valve is closed off by the driving force of a spring, there is a lack of stability in the operation of the throttle valve in cases where the filling process involves a high-viscosity liquid. (3) The dripping of the liquid is not suppressed. (4) Cleaning involves disassembly of the nozzle in order to clean away the liquid that has entered the areas of sliding elements, and thus an efficient CIP is not performed. (5) Since the center rod and throttle valve are in a constant sliding motion, matters are generated by wear and admixed in the liquid.

SUMMARY OF THE INVENTION

Accordingly, the main object of the present invention is to provide a liquid filling nozzle used in a liquid filling apparatus that with a simple structure suppresses the scattering of liquid from the discharge port in the final stage of filling of the liquid into containers, suppresses the dripping of the liquid after closing the discharge port, has an improved maintenance characteristics and allows cleaning-in-place (CIP) to be performed.

Another object of the present invention is to provide a liquid filling nozzle used in a liquid filling apparatus that prevents the admixture of matters, which are created by wear of the components, into the liquid filled in containers.

The above objects are accomplished by a unique structure for a liquid filling nozzle that includes: a tubular nozzle main body that has a liquid supply opening formed in the side wall and a discharge port formed in the lower end, a center rod disposed inside the nozzle main body concentrically, a raising-and-lowering device which raises and lowers the center rod, and an opening-and-closing valve body which is provided at the lower end of the center rod so as to open the discharge port when the center rod is lowered and to close the discharge port when the center rod is raised; and the liquid that enters via the liquid supply opening flows out from the discharge port through a flow path which is provided between the inside wall surface of the nozzle main body and the outer surface of the center rod; and in the present invention, the liquid filling nozzle further includes a throttle valve mechanism which is disposed below the liquid supply opening inside the nozzle main body and constricts the flow path for the liquid; and the throttle valve mechanism is comprised of:

a throttle valve seat provided on the inside wall surface of the nozzle main body, and a throttle valve body provided on the center rod; and the throttle valve mechanism opens when the center rod is lowered, and, when the center rod is raised, the throttle valve mechanism closes before the opening-and-closing valve body closes off the discharge port, thus constricting the flow path.

In this structure, the opening-and-closing valve body and the throttle valve body can be formed on the center rod integrally, and the throttle valve seat can be formed on the nozzle main body integrally. Instead, the opening-and-closing valve body, throttle valve body and throttle valve seat can be formed as an independent element respectively and mounted on the center rod or on the nozzle main body so as to form an integral body.

In the above throttle valve mechanism: the throttle valve seat is a hollow cylindrical form and disposed on the inside wall surface of the nozzle main body, and the throttle valve body is a solid cylindrical form and disposed on the center rod so as to fit inside the throttle valve seat; and the throttle valve body is separated from the throttle valve seat when the center rod is lowered, and, when the center rod is raised, at least part of the throttle valve body is moved into the throttle valve seat before the opening-and-closing valve body closes off the discharge port, thus constricting the flow path.

In this structure, the throttle valve seat is formed inside the nozzle main body and at the position where the inner diameter defined by the inside wall surface of the nozzle main body is formed smaller, and the throttle valve body is formed on the center rod at a position where the center rod expands outward and its external diameter is formed larger.

It is preferable that the lower part of the throttle valve seat and a larger-diameter portion below such a lower part be formed continuously by a taper, and/or the upper part of the throttle valve body and a smaller-diameter portion above such an upper part be formed continuously by a taper The above described liquid filling nozzle is especially, well manifested when such a liquid filling nozzle is used in a liquid filling apparatus that is comprised of one or more such liquid filling nozzles, a pressurizing tank that stores a liquid, and a liquid flow path that connects the liquid supply opening of each one of the liquid filling nozzles to the pressurizing tank (see the above-described Japanese Patent Application Laid-Open (Kokai) No. 11-193094). However, the liquid filling nozzle of the present invention can be used also in a liquid filling apparatus of the type in which a metering cylinder is disposed between a liquid tank and liquid filling nozzles so that the liquid is sucked into the metering cylinder from the liquid tank and measured and then the liquid is fed to the liquid filling nozzles by a piston (see the above-described Japanese Patent Application Laid-Open (Kokai) No. 4-201801 and Japanese Utility Model Application Publication (Kokoku) No. 7-2479).

DETAILED DESCRIPTION OF THE INVENTION

The liquid filling nozzle of the present invention will be described in detail below with reference to FIGS. 1 through 4(*b*).

Figure 1:
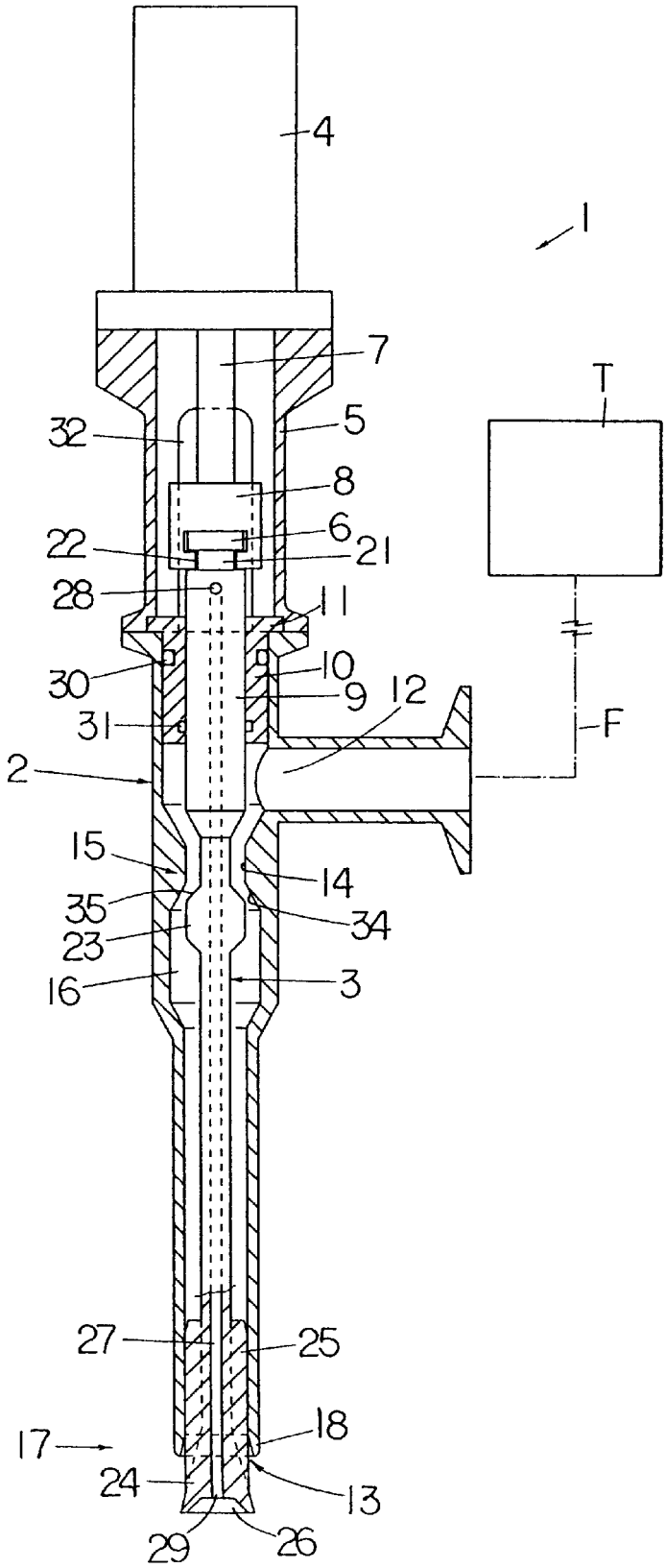
FIG. 1 is a sectional side view (with the opening-and-closing valve mechanism open) of the liquid filling nozzle according to the present invention.
Figure 2:
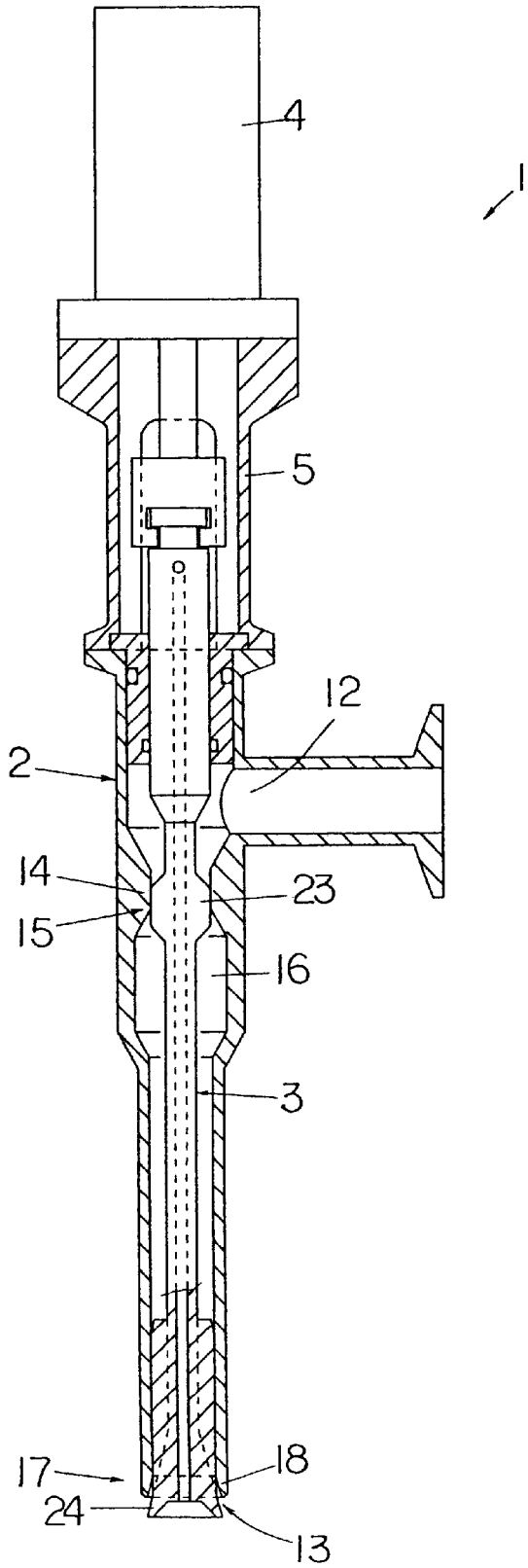
FIG. 2 is a side view thereof (showing the state immediately prior to the closing of the opening-and-closing valve mechanism)
Figure 3:
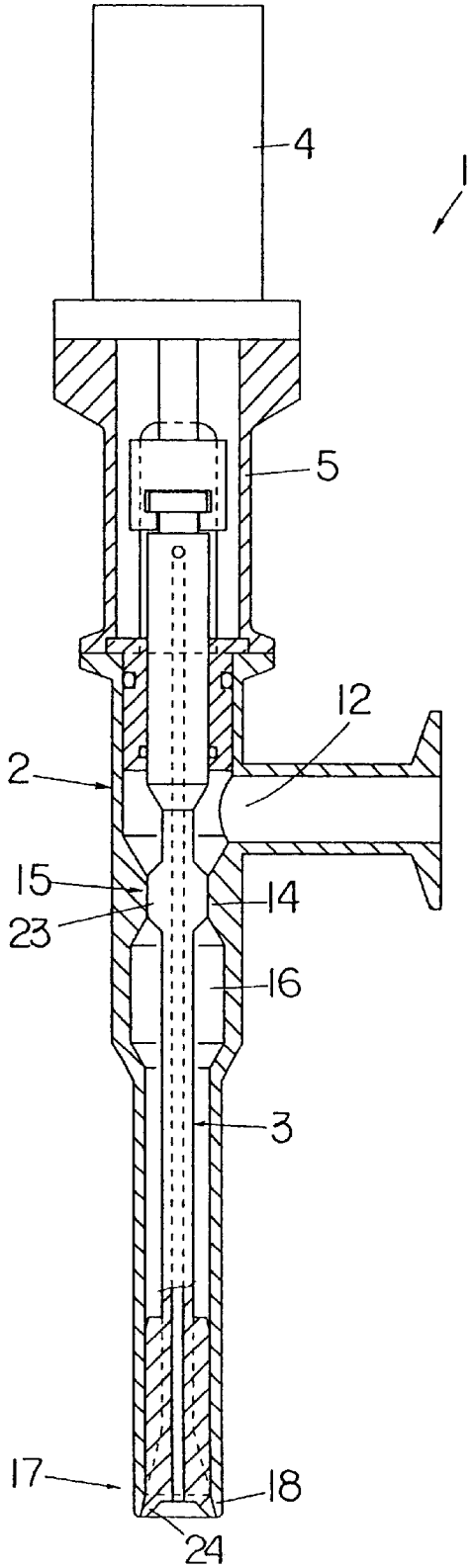
FIG. 3 is another side view thereof (with the opening-and-closing valve mechanism closed)

The main constituting elements of the liquid filling nozzle 1 shown in FIGS. 1 through 3 are a tubular nozzle main body 2, a center rod 3 which is concentrically disposed inside this tubular nozzle main body 2, and an air cylinder 4 that moves the center rod 3 up and down.

The nozzle main body 2 is fastened to the lower portion of a raising-and-lowering holder 5 which is attached to a raising-and-lowering means (not shown) so as to be raised and lowered, and the air cylinder 4 is mounted to the upper portion of this raising-and-lowering holder 5. The head element 6 of the center rod 3 is engaged with an engaging member 8 that is fastened to the lower portion of the piston rod 7 of the air cylinder 4, and the sliding part 9 of the center rod 3 is held slidably inside a center rod holder 10 which is fitted in the upper portion of the nozzle main body 2. The center rod holder 10 is fastened with its flange 11 being held between the nozzle main body 2 and the raising-and-lowering holder 5.

The structure described above is substantially the same as that of a conventional liquid filling nozzle.

A liquid supply opening 12 which leads to a liquid passage F that is connected to the pressurizing tank T is formed in the side wall of the nozzle main body 2, and a liquid discharge port 13 is formed in the lower end of the nozzle main body 2. A cylindrical throttle valve seat 14 is provided beneath the liquid supply opening 12. The cylindrical throttle valve seat 14 forms a throttle valve mechanism 15 together with a throttle valve body 23 (described later).

As to the inside of the nozzle main body 2, the portion from its upper end to the throttle valve seat 14 has a larger internal diameter, and the inside of the nozzle main body 2 is formed so as to have a smaller diameter at the position where the throttle valve seat 14 is disposed with a tapered section that makes a "transitional region (or an upper transitional region)" in between.

The internal diameter increases over a specified range beneath the throttle valve seat 14 so as to form a reduced-pressure chamber 16 with a tapered section that makes another "transitional region (or a lower transitional region)" in between.

The portion beneath the reduced-pressure chamber 16 is formed so as to have a smaller diameter, and this portion at its lower end is formed into a conical shape. This lower end, together with an opening-and-closing valve body 24 (described later), forms an opening-and-closing valve seat 18 that constitutes an opening-and-closing mechanism 17.

The head element 6 of the center rod 3 has a smaller-diameter annular recess 21 formed underneath, and an inward-facing engaging portion 22 of the engaging member 8 engages with this annular recess 21. The portion under the sliding part 9 is formed so as to have a smaller diameter, and a throttle valve body 23 that has a larger diameter (whose external diameter expands outward) is formed on this center rod 3. The area between the throttle valve body 23 and the smaller-diameter portion which is above the throttle valve body 23 has a tapered shape so as to make a "transitional region (or a top transitional region);" and the area between the throttle valve body 23 and the smaller-diameter portion which is below the throttle valve body 23 has a tapered shape so as to make another "transitional region (or a bottom transitional region)."

The throttle valve body 23 is formed so that its external diameter is slightly smaller than the internal diameter of the throttle valve seat 14, so that a metal touching between the throttle valve body 23 and the throttle valve seat 14 is prevented. However, it is desirable that the difference in diameter (clearance) between the two elements (the throttle valve body 23 and the throttle valve seat 14) be small so that a liquid flow path is constricted to be as small as possible when the throttle valve body 23 is moved into the throttle valve seat 14.

Figure 4A:
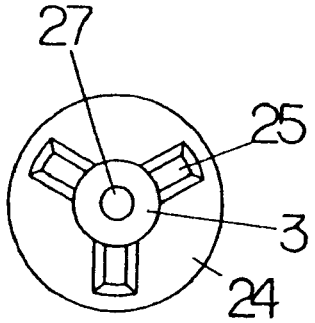
FIG. 4(*a*) is a sectional top view of the opening-and-closing valve body and its surrounding area, and FIG. 4(*b*) is a side view thereof.
Figure 4B:
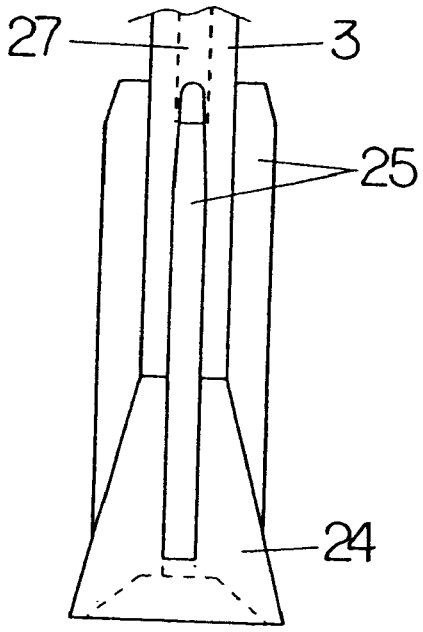

The center rod 3 is further formed with an opening-and-closing valve body 24 at its lower end. The external diameter of the opening-and-closing valve body 24 increases in the shape of a cone (or increases toward its lower end). As shown in FIGS. 4(*a*) and 4(*b*), three flow regulation fins 25 are formed in the longitudinal direction in a specified range on the outer surface of the center rod 3 so that the flow regulation fins 25 are provided in an area above the vicinity of the lower end of the opening-and-closing valve body 24 (the location that corresponds to the opening-and-closing valve seat 18). Furthermore, a bottom recess 26 that has a cross-sectional shape of a truncated cone is formed in the undersurface of the opening-and-closing valve body 24.

In these respects, the liquid filling nozzle is substantially the same as a known liquid filling nozzle.

In addition, an air passage 27 is formed in the axial center of the center rod 3. An upper opening 28 at the upper end of the air passage 27 is connected to a compressed air supply source via a filter, throttle valve, switching valve, etc. (not shown); and a lower opening 29 at the lower end of the air passage 27 opens into the center of the bottom recess 26.

As best seen from FIG. 1, annular circumferential grooves are formed in the outer circumferential surface and inner circumferential surface of the center rod holder 10, and O-rings 30 and 31 used for sealing are respectively installed in these annular circumferential grooves.

A pair of (front and back) cut-out openings 32 (only one cut-out opening is shown) are formed in the side surfaces of the raising-and-lowering holder 5, so that the assembly/disassembly and positional adjustment of the center rod 3 can be performed via these cut-out openings 32.

In these respects as well, the liquid filling nozzle is substantially the same as a known liquid filling nozzle.

In the present invention, as seen from FIGS. 1 through 3, the positional relationship of the throttle valve body 23 and the throttle valve seat 14 of the throttle valve mechanism 15 is set in the following manner:

(1) When, as shown in FIG. 1, the center rod 3 is lowered, the throttle valve body 23 is moved out of (and apart from) the throttle valve seat 14 (thus causing the throttle valve mechanism to open);

(2) When the center rod 3 is raised, as seen from FIG. 2, a portion (the upper portion) of the throttle valve body 23 enters into the throttle valve seat 14 (thus causing the throttle valve mechanism to close) and constricts the flow passage, and this occurs prior to the closing of the liquid discharge port 13 that is caused by the opening-and-closing valve body 24 coming into contact with the opening-and-closing valve seat 18 (which causes the opening-and-closing valve mechanism to close); and (3) When, as shown in FIG. 3, the center rod 3 is further raised so that the opening-and-closing valve body 24 contacts the opening-and-closing valve seat 18 and closes off the liquid discharge port 13 (thus causing the opening-and-closing valve mechanism to close), the throttle valve body 23 fits inside the throttle valve seat 14 (thus causing the throttle valve mechanism to close).

In the above stage (2), it is sufficient that before the opening-and-closing valve mechanism 17 is closed, at least part of the throttle valve body 23 is moved into and fits in the throttle valve seat 14 so as to constrict the flow path. More specifically, the positions of the throttle valve body 23 and the throttle valve seat 14 are set at an appropriate timing at which the throttle valve mechanism 15 closes and constricts the flow path before the liquid discharge port 13 is constricted (by the opening-and-closing valve body 24) and the liquid that flows out of the liquid discharge port 13 is accelerated if the throttle valve mechanism 15 were not in operation.

In stage (3), it is naturally necessary that when the opening-and-closing mechanism 17 closes, not the entirety of the throttle valve body 23 is moved out of the throttle valve seat 14 but at least part (the lower part) of the throttle valve body 23 remains in the throttle valve seat 14 (thus, the closed state of the throttle valve mechanism is maintained).

In the liquid filling nozzle 1 described above, the throttle valve body 23 is first moved into the throttle valve seat 14 (i.e., the throttle valve mechanism 15 closes) when the center rod 3 is raised. Immediately prior to the point in time at which the throttle valve body 23 is moved into the throttle valve seat 14, the gap between these two elements (the throttle valve body 23 and the throttle valve seat 14) is abruptly narrowed, and the flow velocity of the liquid there increases. However, since the gap is narrow (or small), the flow rate of the liquid decreases; and since the liquid flows into the reduced-pressure chamber 16 that has a larger cross-sectional area, the flow velocity decreases, and as a result, the liquid that flows out of the liquid discharge port 13 is not accelerated. When the opening-and-closing valve mechanism 17 closes, the gap at the liquid discharge port 13 (or the gap between the liquid discharge port 13 and the opening-and-closing valve body 24) is abruptly narrowed by the opening-and-closing valve body 24. However, at this point (of timing), the throttle valve mechanism 15 has already closed so as to constrict the flow path; as a result, the liquid flowing out of the liquid discharge port 13 is not accelerated, and scattering of the liquid is prevented.

Furthermore, in the nozzle main body 2, the "transitional region (or the lower transitional region which is the tapered part 34)" is provided between the throttle valve seat 14 and the reduced-pressure chamber 16; and on the center rod 3, the "transitional region (or the top transitional region which is the tapered part 35) is provided between the throttle valve body 23 and the smaller-diameter portion that is above the throttle valve body 23. Thus, compared to a filling nozzle that is not formed with such transitional regions (tapered parts), the gap between the throttle valve body 23 and throttle valve seat 14 (i.e., the cross-sectional area of the flow path) of the shown embodiment becomes smaller (when the throttle valve mechanism 15 closes) at a slightly slower rate (assuming that the center rods are raised at the same rate in the nozzle without the transitional regions and in the nozzle with the transitional regions). As a result, in the above embodiment, the increase in the flow velocity of the liquid flowing into the reduced-pressure chamber is alleviated.

In addition, even after the upper part of the throttle valve body 23 is moved into the throttle valve seat 14, the center rod 3 is still raised until the opening-and-closing valve body 24 comes into contact with the opening-and-closing valve seat 18; and during this process, the throttle valve body 23 moves upward inside the throttle valve seat 14. As a result, the overall volume of the flow path on the downstream side of the throttle valve mechanism 15 (i.e., the volume between the inner surface of the nozzle main body 1 and the outer surface of the center rod 3) increases, and a state of negative pressure is created there. Accordingly, a so-called "suck-back" effect is generated; and thus, the adhesion of liquid droplets to the lower part of the liquid discharge port 13 is suppressed, and the dripping of the liquid is prevented. By way of jetting compressed air out of the lower opening 29 of the air passage 27, it is possible to blow the adhering liquid downward, thus making the effect of preventing dripping of the liquid enhanced.

In the liquid filling nozzle 1 described above, the nozzle structure is extremely simple. If cleaning water is introduced inside the nozzle 1 with the center rod 3 fully lowered and the opening-and-closing valve mechanism 17 and the throttle valve mechanism 15 both opened as shown in FIG. 1, then there is no place in the area extending from the liquid supply opening 12 to the liquid discharge port 13 that cannot be reached by the cleaning water. Accordingly, a so-called CIP (cleaning-in-place) is performed. Thus, the nozzle is superior in terms of maintenance characteristics. Also, there are no replacement parts in the flow path of the filling liquid. The nozzle is superior in terms of maintenance characteristics in this aspect as well. Furthermore, since no springs, etc. are used, stable filling of liquid into containers can be accomplished regardless of the viscosity of the liquid, and there is no admixture of matters, which are generated by wear of the parts, into the containers.

In the above described liquid filling nozzle 1, as best seen from FIG. 3, the length of the throttle valve body 23, which is a solid cylinder, and the length of the throttle valve seat 14, which is a hollow cylinder, are set to be the same. Accordingly, the throttle valve body 23 and the throttle valve seat 14 overlap precisely when the opening-and-closing valve mechanism 17 is closed. However, the present invention is not limited to such an arrangement. In short, as described above, it is sufficient if at least part of the throttle valve body 23 is inside the throttle valve seat 14 so as to constrict the flow path of the liquid before the liquid discharge port 13 is closed by the opening-and-closing valve body 24; and it is also sufficient if at least part of the throttle valve body 23 is inside the throttle valve seat 14 when the opening-and-closing valve body 24 comes into contact with the opening-and-closing valve seat 18.

Furthermore, in the liquid filling nozzle 1 described above, the throttle valve body 23 is a solid cylinder, and the throttle valve seat 14 is a hollow cylinder with no part mounted thereon. However, the throttle valve body 23 and the throttle valve seat 14 both can be formed with annular circumferential grooves with O-rings installed in such grooves. Though the problems of replacing and wear of O-rings would occur in this structure, the liquid flow path still can be completely closed by the throttle valve mechanism, and the effects of suppressing of the scattering of the liquid and suppressing of the dripping of the liquid at the time of the opening-and-closing valve mechanism closing are enhanced.

As seen from the above, according to the present invention, scattering of the liquid from the liquid discharge port in the final stage of filling process of the liquid into containers and dripping of the liquid after the closing of the liquid discharge port can be suppressed by a simple structure. At the same time, the liquid filling nozzle has an improved maintenance characteristics since cleaning-in-place (CIP) can be performed.

What is claimed is:

1. A liquid filling nozzle comprising:

a tubular nozzle main body with a liquid supply opening formed in a side wall thereof and a liquid discharge port formed in a lower end thereof, a center rod disposed inside said nozzle main body concentrically, a raising-and-lowering device which raises and lowers said center rod, and an opening-and-closing valve body which is provided at a lower end of said center rod and opens said liquid discharge port when said center rod is lowered and closes said liquid discharge port when said center rod is raised, so that a liquid that enters via said liquid supply opening flows out of said liquid discharge port through a flow path which is between an inside wall surface of said nozzle main body and an outer surface of said center rod; and said liquid filling nozzle further comprising:

a throttle valve mechanism which is disposed in a position below said liquid supply opening inside said nozzle main body and constricts said flow path for said liquid, said throttle valve mechanism being comprised of:

a throttle valve seat which is disposed on said inside wall surface of said nozzle main body, and a throttle valve body which is provided on said center rod, and wherein said throttle valve mechanism opens when said center rod is lowered, and, when said center rod is raised, said throttle valve mechanism closes before said opening-and-closing valve body closes off said liquid discharge port, thus constricting said flow path.

2. The liquid filling nozzle according to claim 1, wherein:

said throttle valve seat is in a hollow cylindrical form and is disposed on said inside wall surface of said nozzle main body, and said throttle valve body is in a solid cylindrical form and is disposed on said center rod so as to fit inside said throttle valve seat; and wherein said throttle valve body is separated from said throttle valve seat when said center rod is lowered, and, when said center rod is raised, at least part of said throttle valve body is moved into said throttle valve seat before said opening-and-closing valve body closes off said liquid discharge port, thus constricting said flow path.

3. The liquid filling nozzle according to claim 2, wherein:

said throttle valve seat is provided at a position where an internal diameter of said nozzle main body is reduced to a smaller diameter, and said throttle valve body is provided at a position where an external diameter of said center rod is increased to a larger diameter.

4. The liquid filling nozzle according to claim 3, wherein:

a lower part of said throttle valve seat and a larger-diameter portion below said lower part are formed continuously by a taper, and an upper part of said throttle valve body and a smaller-diameter portion above said upper part are formed continuously by a taper.

5. The liquid filling nozzle according to claim 3, wherein:

a lower part of said throttle valve seat and a larger-diameter portion below said lower part are formed continuously by a taper, or an upper part of said throttle valve body and a smaller-diameter portion above said upper part are formed continuously by a taper.

6. A liquid filling apparatus comprising:

one or more of said liquid filling nozzles according to any one of claims 1 through 5, a pressurizing tank which stores a liquid, and a liquid flow path which connects said liquid supply opening of each of said liquid filling nozzles to said pressurizing tank.

* * * * *